US009695687B2

(12) United States Patent
Weber et al.

(10) Patent No.: US 9,695,687 B2
(45) Date of Patent: Jul. 4, 2017

(54) BLOCK WITH COOLANT DELIVERY

(71) Applicant: Kennametal Inc., Latrobe, PA (US)

(72) Inventors: Luke A. Weber, Bedford, PA (US); Eric P. Helsel, New Enterprise, PA (US); David S. Rose, Windber, PA (US); Jeremiah L. Jonsrud, Saint Paul, VA (US)

(73) Assignee: KENNAMETAL INC., Latrobe, PA (US)

( * ) Notice: Subject to any disclaimer, the term of this patent is extended or adjusted under 35 U.S.C. 154(b) by 26 days.

(21) Appl. No.: 14/716,994

(22) Filed: May 20, 2015

(65) Prior Publication Data

US 2016/0341040 A1 Nov. 24, 2016

(51) Int. Cl.
*E21C 35/187* (2006.01)
*E21C 35/22* (2006.01)
*E21C 35/18* (2006.01)

(52) U.S. Cl.
CPC ..... *E21C 35/187* (2013.01); *E21C 35/22* (2013.01); *E21C 2035/1826* (2013.01)

(58) Field of Classification Search
CPC ..... E21C 35/187; E21C 35/22; E21C 2035/1826; E21C 35/23; B28D 7/02; E21B 10/61
See application file for complete search history.

(56) References Cited

U.S. PATENT DOCUMENTS 4,333,687 A 6/1982 Barnstorf
4,497,520 A 2/1985 Ojanen
4,542,942 A * 9/1985 Zitz ..... E21C 35/187 175/393
4,668,018 A * 5/1987 Demoulin ..... E21C 35/23 299/17
5,195,805 A * 3/1993 Clapham ..... E21C 35/187 239/600
5,378,048 A 1/1995 Parrott
5,494,122 A * 2/1996 Larsen ..... E21B 10/18 175/340
6,099,081 A * 8/2000 Warren ..... E21C 35/187 299/104
6,247,759 B1 * 6/2001 Montgomery, Jr. .. E21C 35/187 175/424
6,257,672 B1 7/2001 Parrott
6,485,104 B1 11/2002 Keller
6,536,847 B2 3/2003 Clapman et al.
(Continued)

*Primary Examiner* — David Bagnell
*Assistant Examiner* — Michael Goodwin
(74) *Attorney, Agent, or Firm* — Matthew S. Bedsole

(57) ABSTRACT

A block for use in a cutting assembly wherein the block includes a block body that contains a reservoir with coolant therein. The block body contains a top passage operative communication with the reservoir so as to receive coolant. The top passage has an axial forward top passage section terminating in an axial forward top passage end. The axial forward top passage section has an axial forward top passage section central longitudinal axis. The top passage further has an axial rearward top passage section terminating in an axial rearward top passage end. The axial rearward top passage section has axial rearward top passage section central longitudinal axis. The axial forward top passage section central longitudinal axis is disposed at an angle with respect to the axial rearward top passage section central longitudinal axis.

15 Claims, 18 Drawing Sheets

(56) References Cited

U.S. PATENT DOCUMENTS

| | | | | |
|---|---|---|---|---|
| 6,758,529 | B2 | 7/2004 | Parrott | |
| 6,764,141 | B2 | 7/2004 | O'Neill | |
| 7,097,257 | B2 | 8/2006 | Stehney | |
| 8,061,783 | B2 | 11/2011 | Keller et al. | |
| 8,322,795 | B2 | 12/2012 | Zimmerman et al. | |
| 8,573,706 | B2 | 11/2013 | Parrott et al. | |
| 8,579,380 | B2 | 11/2013 | Parrott | |
| 8,740,314 | B2 | 6/2014 | O'Neill | |
| 2004/0118615 | A1* | 6/2004 | Beach | E21C 35/197 175/394 |
| 2011/0181098 | A1* | 7/2011 | Zimmerman | E21C 35/18 299/113 |
| 2014/0312678 | A1* | 10/2014 | Parrott | B05B 15/065 299/81.3 |
| 2016/0215620 | A1* | 7/2016 | Arnold | E21C 35/187 |

* cited by examiner

BLOCK WITH COOLANT DELIVERY

BACKGROUND

The present invention pertains to a block with coolant delivery, as well as to a cutting assembly using the block with coolant delivery. More specifically, the invention pertains to a block with coolant delivery, as well as to a cutting assembly using the block with coolant delivery, wherein the block provides for enhanced cooling of the cutting bit during a cutting operation through selective customization of the coolant spray to correspond to the specific cutting operation.

In the past, a cutting assembly may comprise a driven member (e.g., rotatable drum) wherein the block is affixed such as by welding to the surface of the driven member. The block contains a retention bore that receives a cutting bit assembly wherein the cutting bit assembly may comprise a rotatable cutting bit alone. U.S. Pat. No. 4,497,520 to Ojanen discloses a cutting assembly that comprises a block that receives a cutting bit, which carries a resilient retainer, alone. The block does not provide for coolant delivery. As an alternative, the cutting bit assembly comprises the combination of a sleeve that receives a rotatable cutting bit. U.S. Pat. No. 8,061,783 to Keller et al. discloses a block that receives the combination of a non-rotatable sleeve and cutting bit. The block does not provide for coolant delivery.

Although the blocks disclosed in U.S. Pat. No. 4,497,520 to Ojanen and U.S. Pat. No. 8,061,783 to Keller et al. do not provide for coolant delivery, heretofore, some blocks provide for coolant delivery. In this regard, exemplary patent documents that pertain to a block with coolant delivery are set forth as follows: U.S. Pat. No. 4,333,687 to Barnstorf; U.S. Pat. No. 6,257,672 to Parrott; U.S. Pat. No. 6,485,104 to Keller; U.S. Pat. No. 6,536,847 to Clapman et al.; U.S. Pat. No. 6,764,141 to O'Neill; U.S. Pat. No. 7,097,257 to Stehney; U.S. Pat. No. 8,322,795 to Zimmerman et al.; U.S. Pat. No. 8,573,706 to Parrott et al.; U.S. Pat. No. 8,579,380 to Parrott; and U.S. Pat. No. 8,740,314 to O'Neill. It is typical that a block contains a spray nozzle to deliver coolant. Exemplary patents that pertain to a spray nozzle include U.S. Pat. No. 5,378,048 to Parrott; and U.S. Pat. No. 6,758,529 to Parrott.

While these earlier structures provide for the delivery of coolant, there remains a need to provide for the improved delivery of coolant to the vicinity of the cutting bit. In this regard, there is a need to provide a block with coolant delivery that can present a selected coolant spray pattern customized to correspond to a specific cutting application. Customization of the spray pattern results in an enhancement of the delivery of the coolant to the vicinity of the cutting bit during a cutting operation. By enhancing the delivery of coolant in the vicinity of the cutting bit during the cutting operation, the block provides operational advantages not heretofore available. More specifically, one advantage of the block with coolant delivery is the capability of the block to deliver coolant to the substrate prior to the impingement of the substrate with the cutting bit. This feature provides for dust suppression during the mining operation.

Yet, another advantage of the block is the selective delivery of coolant to the vicinity of the tip of the cutting bit, as well as to the vicinity of the rear of the cutting bit. Sparks generated from the impingement of the tip of the cutting bit on the substrate occur both in the vicinity of the tip and at a location to the rear of the tip of the cutting bit. Another advantage of the block with coolant delivery is the variability of the coolant spray pattern due to the capability of the block to provide a variety of spray patterns depending upon the nozzle selection.

Another advantage is that the block with coolant delivery is indexable. The index-ability of the block with coolant delivery allows for using the blocks in conjunction with either a right-handed vane or a left-handed vane. This feature of index-ability reduces the number of blocks that must be kept in inventory since the block with coolant delivery can be used in conjunction with either a right-handed vane or a left-handed vane. It is not necessary to inventory a special right-handed block and a special left-handed block.

Another advantage with the block with coolant delivery is that it presents a footprint which allows it to be welded so as to have a better weld. More specifically, the geometry of the footprint on the base of the block is such that there is a 360° weld around the base of the block to the vane of the longwall miner drum. The base of the block with coolant delivery does not exhibit any overhang thereof relative to the vane, and thus, it able to provide for an improved weld, and to enhance the ease of welding the block to the vane. This advantage of an improved weld due to the footprint of the block applies to both the right-handed vane and the left-handed vane.

Still another advantage is that the forward face of the block with coolant delivery displays a plow design to divert material upon impingement with the coal (or earth) strata.

SUMMARY

In one form thereof, the invention is a block for use in a cutting assembly wherein the cutting assembly comprises a driven member and a coolant source. The block comprises a block body containing a reservoir with coolant therein. The block body further contains a top passage that is in operative communication with the reservoir so as to receive coolant from the reservoir. The top passage has an axial forward top passage section terminating in an axial forward top passage end and which has an axial forward top passage section central longitudinal axis. The top passage further has an axial rearward top passage section terminating in an axial rearward top passage end and which has an axial rearward top passage section central longitudinal axis. The axial forward top passage section central longitudinal axis is disposed at an angle with respect to the axial rearward top passage section central longitudinal axis.

In another form thereof, the invention is a block for use in a cutting assembly wherein the cutting assembly comprises a driven member, a coolant source, and a cutting bit assembly. The block comprises a block body that has a bottom face, a top face, a forward face, and a rearward face. The block body contains a retention bore adapted to receive a cutting bit, and the retention bore has a retention bore central longitudinal axis. The block body contains a reservoir at the bottom surface wherein the reservoir is in communication with the coolant source so as to receive coolant from the coolant source. The reservoir has a forward reservoir outlet and a rearward reservoir outlet. The block body contains a bottom passage having an axial forward bottom passage end and an axial rearward bottom passage end. The axial rearward bottom passage end is at the forward reservoir outlet of the reservoir whereby the bottom passage receives coolant from the reservoir through the forward reservoir outlet and the axial rearward bottom passage end. The bottom passage contains a bottom passage threaded region adjacent the axial forward bottom passage end. The block body contains a rear passage having a top rear passage end and a bottom rear passage end. The bottom rear passage end is at the rearward reservoir outlet whereby the rear passage receives coolant from the reservoir through the rearward reservoir outlet and the bottom rear passage end. The block body contains a top passage having an axial forward top passage section terminating in an axial forward top passage end and which has an axial forward top passage section central longitudinal axis. The top passage further has an axial rearward top passage section terminating in an axial rearward top passage end and which has an axial rearward top passage section central longitudinal axis. The axial forward top passage section central longitudinal axis is disposed at an angle with respect to the axial rearward top passage section central longitudinal axis. The top rear passage end intersects the top passage in the axial rearward top passage section. The axial rearward top passage section contains a rearward top passage threaded region adjacent the axial rearward top passage end. The axial forward top passage section contains a forward top passage threaded region adjacent the axial forward top passage end. The block contains retention staple holes adjacent the axial forward top passage end In yet another form, the invention is a block-sleeve assembly for use in a cutting assembly wherein the cutting assembly comprises a cutting bit, a driven member and a coolant source. The block-sleeve assembly comprises a sleeve being non-rotatable relative to the block. The sleeve has a sleeve body with a head portion that contains a sleeve notch. The block body contains a reservoir with coolant therein. The block body further contains a top passage, and the top passage is in operative communication with the reservoir so as to receive coolant from the reservoir. The top passage has an axial forward top passage section terminating in an axial forward top passage end. The block body contains a block notch adjacent to the axial forward top passage end. The block notch is in alignment with the sleeve notch to facilitate the flow of coolant from the top passage.

BRIEF DESCRIPTION OF THE DRAWINGS

The following is a brief description of the drawings that form a part of this patent application.

DETAILED DESCRIPTION

Figure 1:
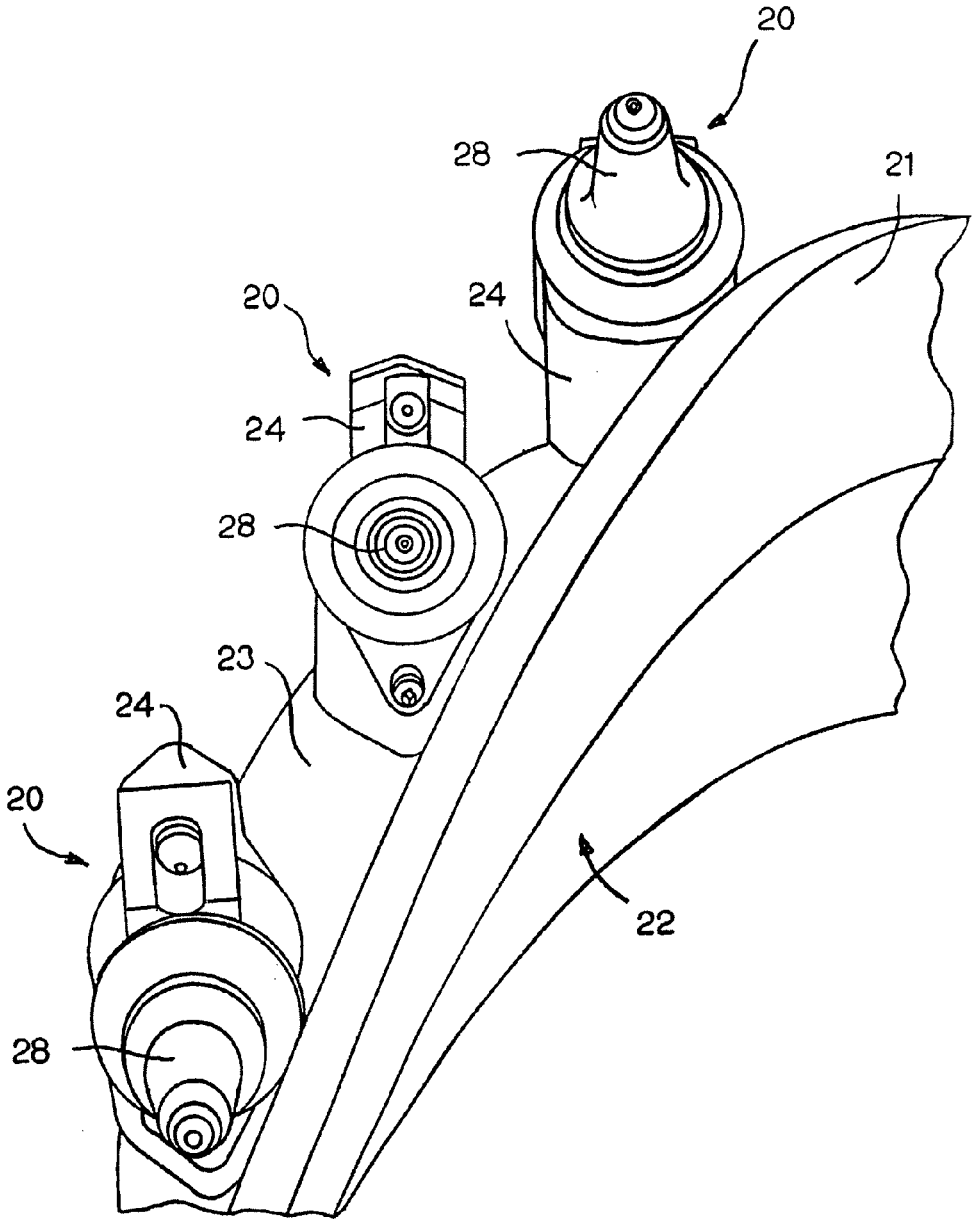
FIG. 1 is a front isometric view of a portion of a cutting assembly wherein the cutting assembly comprises a driven member, a block with coolant delivery and a cutting bit assembly wherein the cutting bit assembly comprises a cutting bit and a sleeve.

The present specific embodiment of a block with coolant delivery provides for the improved delivery of coolant to the vicinity of the cutting bit. The present specific embodiment of the block for coolant delivery has the capability to present a selected coolant spray pattern customized to correspond to a specific cutting application so as to enhance coolant delivery to the vicinity of the cutting bit during a cutting operation. The capability to select a particular spray pattern of the coolant from a plurality of potential spray patterns permits the operator to customize the spray pattern to a specific cutting application. Customization of the spray pattern results in an enhancement of the delivery of the coolant to the vicinity of the cutting bit during a cutting operation. It thus can be appreciated that the specific embodiment of the block with coolant delivery has significant advantages over earlier blocks with coolant delivery.

In reference to these advantages, one advantage of the block with coolant delivery is the capability of the block to deliver coolant to the substrate prior to the impingement of the substrate with the cutting bit. This feature provides for dust suppression during the mining operation.

Yet, another advantage of the block is the selective delivery of coolant to the vicinity of the tip of the cutting bit, as well as to the vicinity of the rear of the cutting bit. Sparks generated from the impingement of the tip of the cutting bit on the substrate occur both in the vicinity of the tip and at a location to the rear of the tip of the cutting bit. Another advantage of the block with coolant delivery is the variability of the coolant spray pattern due to the capability of the block to provide a variety of spray patterns depending upon the nozzle selection.

Another advantage is that the block with coolant delivery is indexable. The index-ability of the block with coolant delivery allows for using the blocks in conjunction with either a right-handed vane or a left-handed vane. This feature of index-ability reduces the number of blocks that must be kept in inventory since the block with coolant delivery can be used in conjunction with either a right-handed vane or a left-handed vane. It is not necessary to inventory a special right-handed block and a special left-handed block.

Another advantage with the block with coolant delivery is that it presents a footprint which allows it to be welded so as to have a better weld. More specifically, the geometry of the footprint on the base of the block is such that there is a 360° weld around the base of the block to the vane of the longwall miner drum. The base of the block with coolant delivery does not exhibit any overhang thereof relative to the vane, and thus, it able to provide for an improved weld, and to enhance the ease of welding the block to the vane. This advantage of an improved weld due to the footprint of the block applies to both the right-handed vane and the left-handed vane.

Still another advantage is that the forward face of the block with coolant delivery displays a plow design to divert material upon impingement with the coal (or earth) strata.

Referring to the drawings, a cutting member is generally designated as 20. The cutting assembly 20 comprises a driven member 22, the block 24, and a cutting bit assembly 29. The specific embodiment of the block 24 provides coolant delivery wherein the block 24 facilitates delivery of coolant to the vicinity of a cutting bit 28 during a cutting operation. The block 24 is a component of a cutting assembly 20. The block 24 is affixed to the top surface of a helical vane 23 of the driven member 22. A helical barrier 21 is adjacent to the helical vane.

The block 24 comprises a block body 40. The block body 40 has a bottom face 42, a top face 44, a forward face 46, and a rearward face 48. The block body 40 further has opposite side faces 50 that extend to the bottom face 42, the top face 44, the forward face 46, and the rearward face 48. Opposite side faces 50 join the bottom face 42, the top face 44, the forward face 46, and the rearward face 48. A mediate passage 52 passes through the block body 40. The block body 40 contains a retention bore 54, which is generally elongate in shape, adapted to receive a cutting bit assembly. The retention bore 54 opens at the forward face 46 of the block body 40, and has an axial forward open end 55. The retention bore 54 has a retention bore central longitudinal axis A-A.

Figure 2:
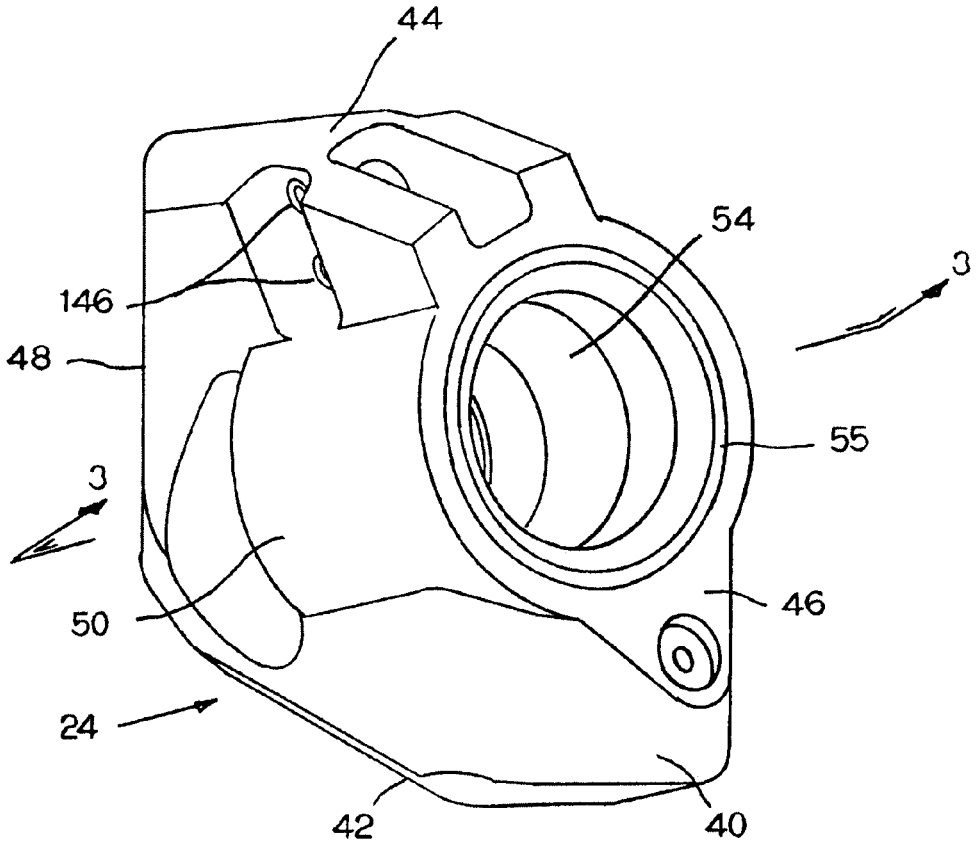
FIG. 2 is an isometric view of a specific embodiment of a block with coolant delivery.
Figure 2A:
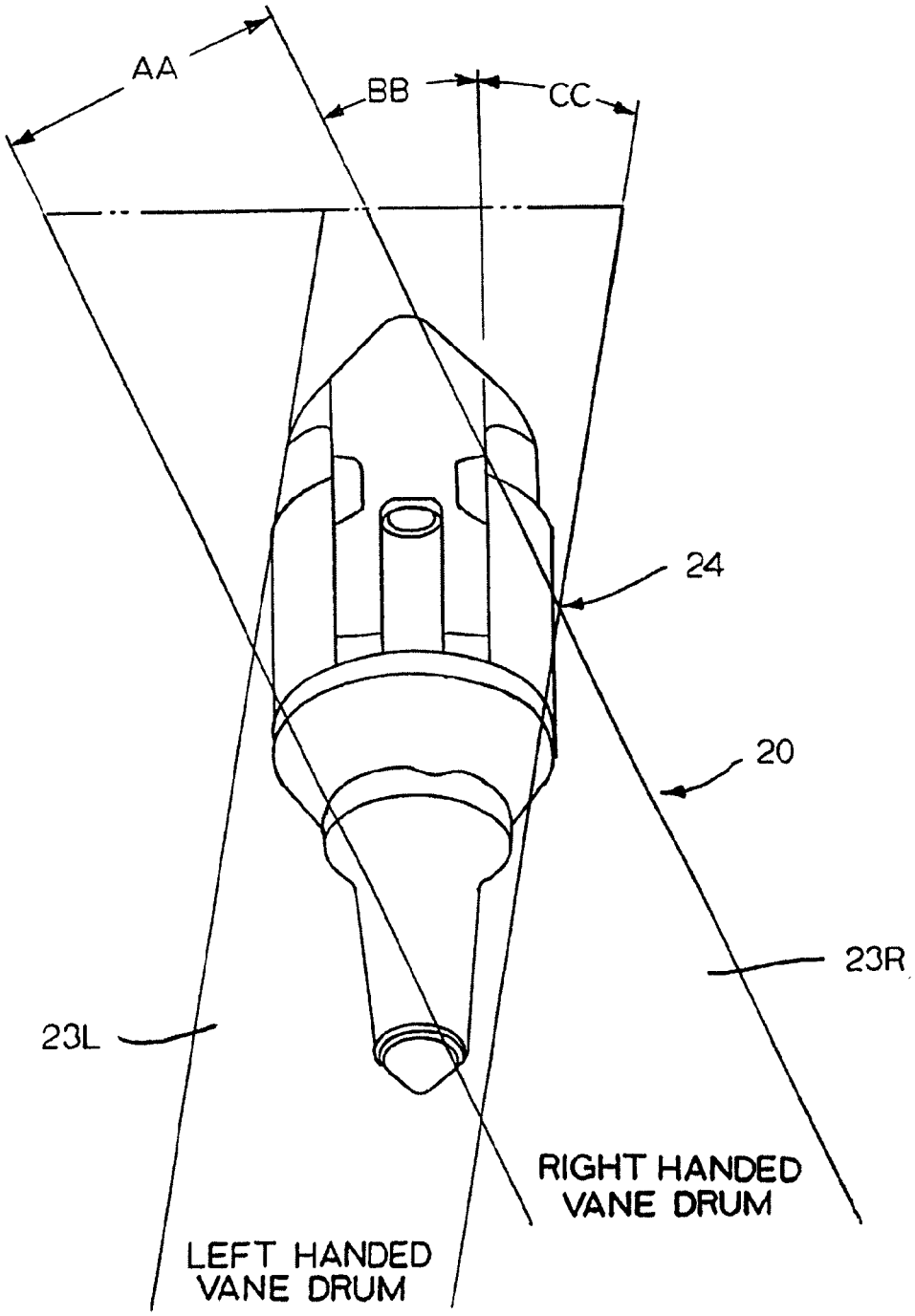
FIG. 2A is a mechanical schematic top view of the block with coolant delivery illustrating the index-ability of the block for use with either a right-handed vane drum or a left-handed vane drum.
Figure 2B:
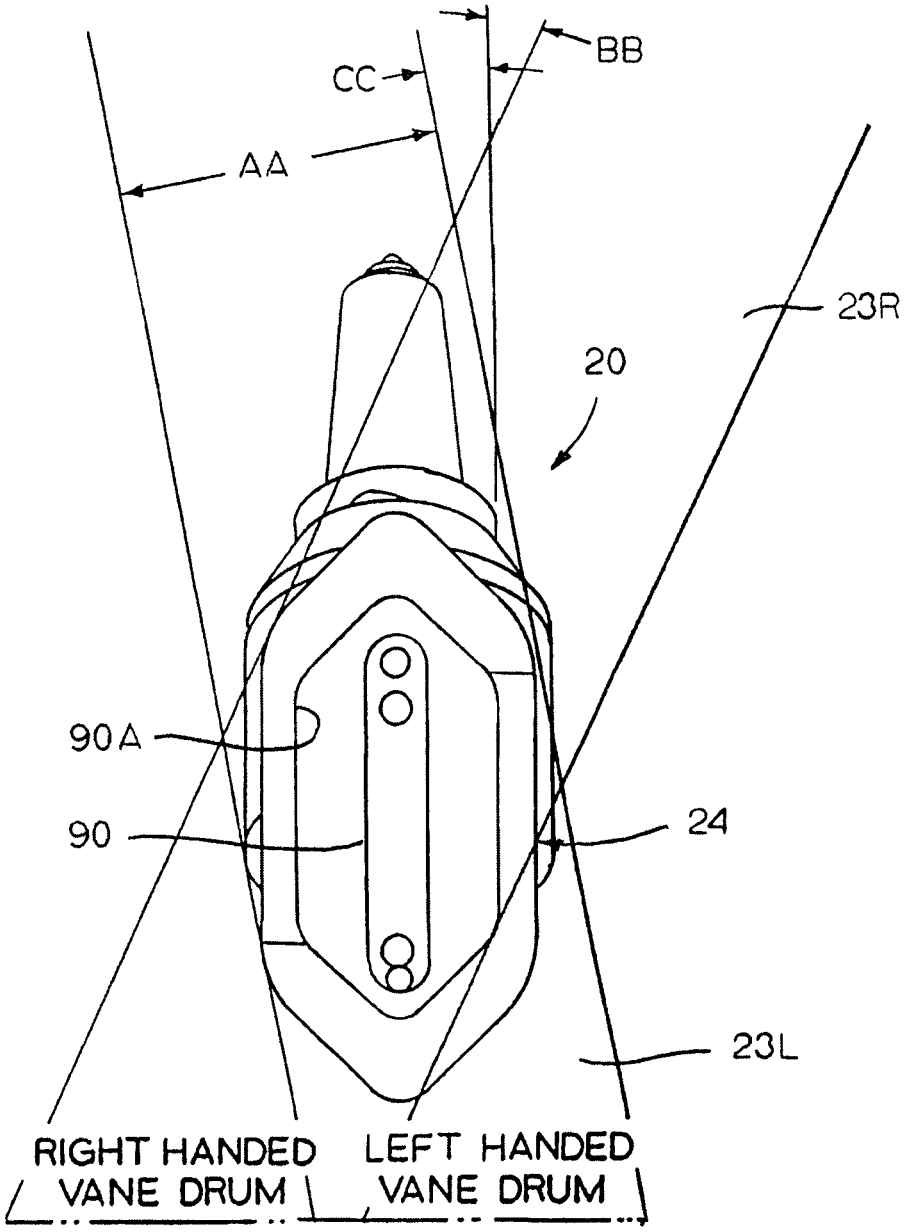
FIG. 2B is a mechanical schematic bottom view of the block with coolant delivery illustrating the index-ability of the block for use with either a right-handed vane drum or a left-handed vane drum.

Referring to FIGS. 2A and 2B, there is shown a mechanical schematic top and bottom views of the indexable block 24 with coolant delivery positioned on either a left-handed vane 23L or a right-handed vane 23R. In these drawings (i.e., FIGS. 2A and 2B), the width of each of the vanes is dimension AA wherein FIG. 2A shows the dimension AA for the right-handed vane 23R and FIG. 2B shows the dimension AA for the left-handed vane 23L. The orientation of the indexable block 24 with coolant delivery on the right-handed vane 23R is shown by angle BB in FIG. 2A and FIG. 2B. The orientation of the indexable block 24 with coolant delivery on the left-handed vane 23L is shown by angle CC in FIG. 2A and FIG. 2B. In these embodiments, angle BB is equal to 25 degrees and angle CC is equal to 10 degrees.

Referring to the bottom schematic view, i.e., FIG. 2B, it is apparent that the corners of the block are rounded. It should be kept in mind that the block typically is positioned so that the front region of the block is near the front of the vane. This is the case for the block when used with the left-handed vane 23L and the right-handed vane 23R.

Further, the footprint of the block with coolant delivery is such that the periphery 90A of the reservoir 90 is within the surface area of the left-handed vane 23L. The periphery is well within the surface of the left-handed vane 23L so as to enhance the ability to attain a 360° weld around the base of the block. While the periphery 90A of the reservoir 90 is closer to the edge of the surface of the right-handed vane 23R, it still remains within the surface of the right-handed vane 23R. This results in the advantage that the block with coolant delivery presents a footprint which allows it to be welded to the right-handed vane 23R so as to have a better weld. More specifically, the geometry of the footprint on the base of the block is such that there is a 360° weld around the base of the block, and especially the periphery 90A of the reservoir 90, to the vane of the longwall miner drum. The base of the block with coolant delivery does not exhibit any significant overhang thereof relative to the vane, and thus, it able to provide for an improved weld, and to enhance the ease of welding the block to the vane. This advantage of an improved weld due to the footprint of the block applies to both the right-handed vane and the left-handed vane.

The cutting bit assembly 29 can comprise a cutting bit 28 alone or, as illustrated in the drawings, a combination of a cutting bit 28 carried by a sleeve 26. The sleeve 26 has a sleeve body 58 that has an axial forward end 60 and an axial rearward end 62. Sleeve 26 has a head portion 64 adjacent to the axial forward end 60 and a shank portion 66 adjacent to the axial rearward end 62. The sleeve 26 contains a cutting bit bore 68 that is adapted to receive the cutting bit 28. The cutting bit 28 has a cutting bit body 72 that has an axial forward end 74 and an axial rearward end 76. Cutting bit 28 has a head section 78 adjacent to the axial forward end 74 and a shank section 80 adjacent to the axial rearward end 76. A hard tip 82, which is made out of a hard material such as, for example, cemented (cobalt) tungsten carbide, is affixed (e.g., by brazing) to the cutting bit body 72 at the axial forward end 74 thereof. A retention clip 84 is at the axial rearward end 76 of the cutting bit body 72.

Figure 3:
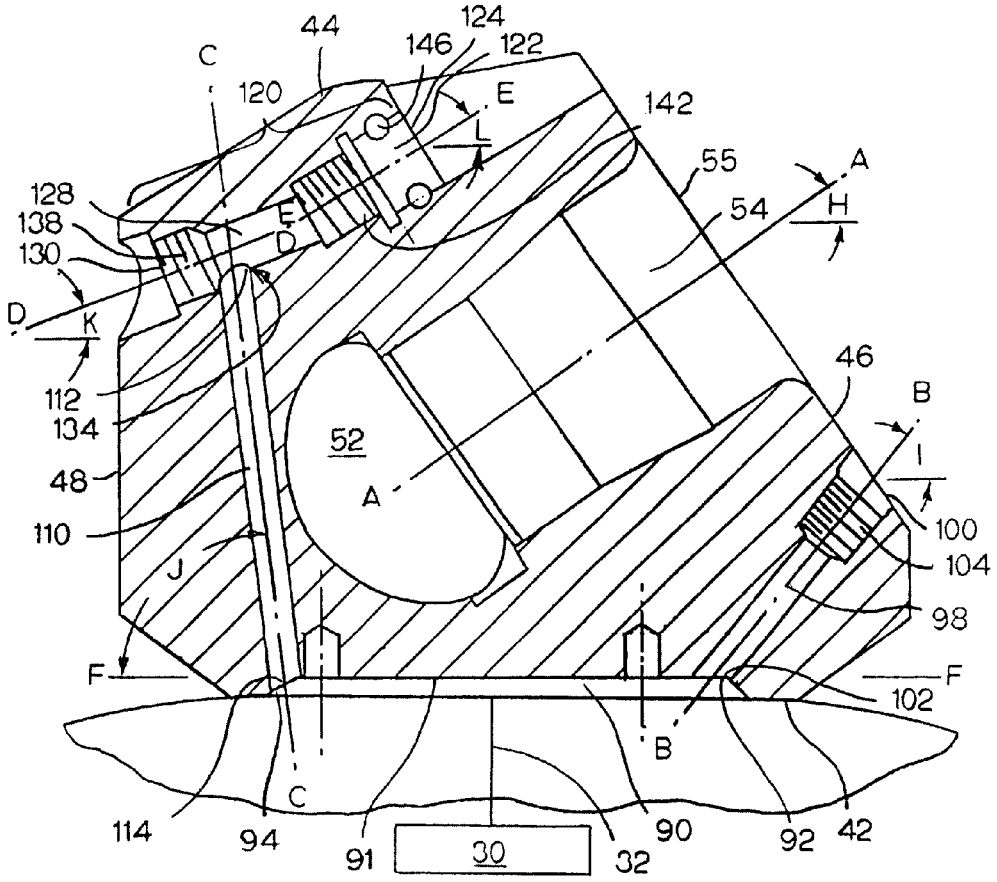
FIG. 3 is a cross-sectional view of the specific embodiment of the block with coolant delivery of FIG. 2 taken along section line 3-3 of FIG. 2.

The block body 40 further contains a reservoir 90 at the bottom surface 42 wherein the reservoir 90 is in communication via a coolant conduit 32 with the coolant source 30 so as to receive coolant under pressure, which is designated as 34, from the coolant source 30. The reservoir 90 has a forward reservoir outlet 92 and a rearward reservoir outlet 94. The block body 40 has a generally flat reservoir surface 91 that defines in part the volume of the reservoir 90. As shown in FIG. 3, the reservoir bottom surface axis F-F is oriented so as to be in the plane defined by the generally flat reservoir surface 91. As will become apparent, the angle of the disposition of various features of the block body 40 can be defined relative to the reservoir bottom surface axis F-F.

The block body 40 contains a bottom passage 98, which has a bottom passage central longitudinal axis B-B, that has an axial forward bottom passage end 100 and an axial rearward bottom passage end 102. The bottom passage central longitudinal axis B-B is disposed relative to the generally flat reservoir surface axis F-F at angle I. The axial rearward bottom passage end 102 is at the forward reservoir outlet 92 of the reservoir 90 whereby the bottom passage 98 receives coolant 34 from the reservoir 90 through the forward reservoir outlet 92 and the axial rearward bottom passage end 102. The bottom passage 98 contains a bottom passage threaded region 104 adjacent the axial forward bottom passage end 100. As will become apparent, a spray nozzle is threadedly affixed in the bottom passage 98 via the bottom passage threaded region 104.

The block body 40 further contains a rear passage 110 having a top rear passage end 112 and a bottom rear passage end 114. The rear passage 110 has a rear passage central longitudinal axis C-C, which is disposed at angle J relative to the generally flat reservoir surface axis F-F. The bottom rear passage end 114 is at the rearward reservoir outlet 94 whereby the rear passage 110 receives coolant 34 from the reservoir 90 through the rearward reservoir outlet 94 and the bottom rear passage end 114.

The block body 40 further contains a top passage 120 that has an axial forward top passage section 122 terminating in an axial forward top passage end 124. The axial forward top passage section 124 has an axial forward top passage section central longitudinal axis E-E which is disposed at an angle L relative to the generally flat reservoir surface axis F-F. The top passage 120 further has an axial rearward top passage section 128 terminating in an axial rearward top passage end 130. The axial rearward top passage section 128 has an axial rearward top passage section central longitudinal axis D-D, which is disposed at an angle K relative to the generally flat reservoir surface axis F-F. There should be an understanding that angle K is not equal to angle L. More specifically, there should be an understanding that angle K is less than angle L. In this regard, the axial rearward top passage section 128, which has the axial rearward top passage section central longitudinal axis D-D, is disposed at an angle P (see FIG. 3A) relative to the axial forward top passage section 122, which has the axial forward top passage section central longitudinal axis E-E.

By providing a top passage 120 with a variation in the orientation, different disposition between the axial forward top passage section 122 relative to the axial rearward top passage section 128, the block body 40 increases the number of spray patterns available for the block 24 to deliver coolant to the vicinity of the cutting bit 28 during the cutting operation. This enhances the capability of the block 24 to provide selective customization of the coolant spray to correspond to a specific cutting application.

The top rear passage end 112 intersects 134 the top passage 120 in the axial rearward top passage section 128 at a location designated as 134.

Figure 3A:
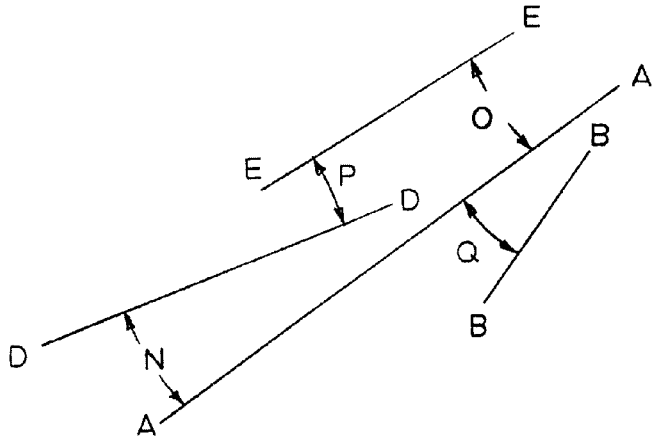
FIG. 3A is a schematic drawing that shows the central longitudinal axes of selected features of the block of FIG. 3 and the angles between these central longitudinal axes.

The various passages also have an orientation relative to the retention bore central longitudinal axis A-A. Referring especially to FIGS. 3 and 3A, the axial rearward top passage section 128 has the axial rearward top passage section central longitudinal axis D-D that is disposed at angle N relative to the retention bore central longitudinal axis A-A. The axial forward top passage section 122 has the axial forward top passage section central longitudinal axis E-E disposed at an angle θ relative to the retention bore central longitudinal axis A-A. The bottom passage central longitudinal axis B-B is disposed at an angle Q relative to the retention bore central longitudinal axis A-A.

Table 1 below sets forth the angles and ranges of angles for selected parameters of the block 24.

TABLE 1

Selected Angles and Ranges of Angles

| Angle Reference | Preferred Value of the Angle in Degrees | One Range of the Angle in Degrees | Another Range of the Angle in Degrees |
|---|---|---|---|
| H | 35° | 30°-40° | 25°-45° |
| I | 50° | 45°-55° | 40°-60° |
| J | 83° | 78°-88° | 73°-93° |
| K | 20° | 15°-25° | 10°-30° |
| L | 30° | 25°-35° | 20°-40° |
| N | 15° | 10°-20° | 5°-25° |
| O | 5° | 1°-10° | 1°-15° |
| P | 10° | 5°-15° | 1°-20° |
| Q | 15° | 5°-20° | 5°-25° |

The axial rearward top passage section 128 contains a rearward top passage threaded region 138 adjacent the axial rearward top passage end 130. The presence of the axial rearward top passage section threaded region 138 allows the block 24 to present various spray patterns. In some conditions, a spray nozzle can be affixed in the top passage 120 via the axial rearward top passage section threaded region 138. In other conditions, a plug 139 can be affixed via the axial rearward top passage section threaded region 138. The plug 139 blocks the flow of coolant out of the axial rearward top passage end 130.

The axial forward top passage section 122 contains an axial forward top passage threaded region 142 adjacent the axial forward top passage end 124. The block body 40 contains retention staple holes 146 adjacent the axial forward top passage end 130. In some conditions, a spray nozzle can be affixed in the top passage 120 via the axial forward top passage threaded region 142. In other conditions, the use of a retention staple in cooperation with the retention staple holes 146 affixed a spray nozzle in the top passage 120.

The block 24 can be in any one of three basic conditions; namely, a rear top spray condition, a mediate top spray condition, and a forward top spray condition. The block 24 in each of these conditions is described below.

Figure 4:
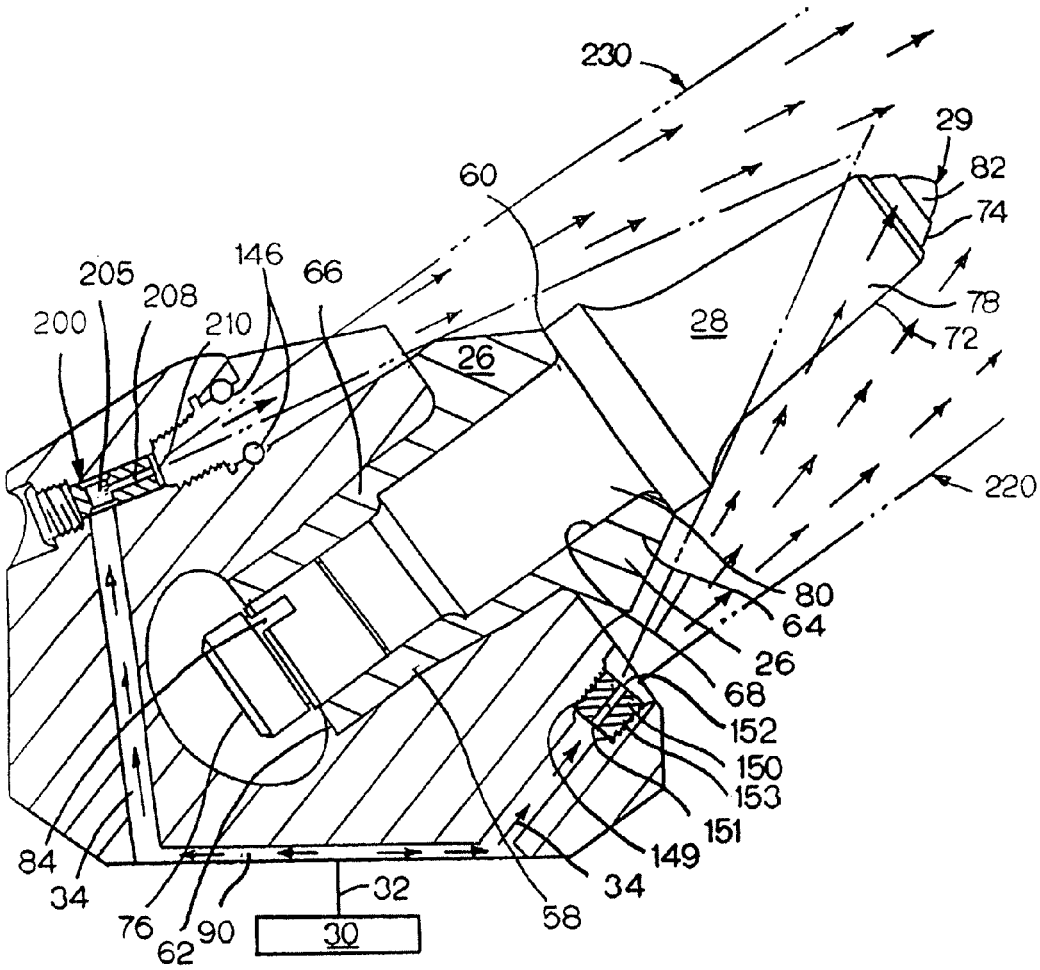
FIG. 4 is a cross-sectional view of the specific embodiment of the block of FIG. 3 with a cutting bit assembly, which comprises a cutting bit and a sleeve, retained in the retention bore of the block and a selected spray nozzle is attached to the block to deliver coolant to the vicinity of the cutting bit during a cutting operation.
Figure 4A:
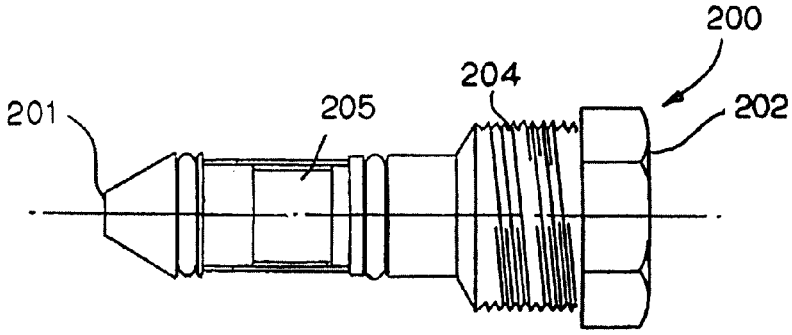
FIG. 4A is a side view of the spray nozzle positioned in the top passage of the block of FIG. 4.
Figure 10:
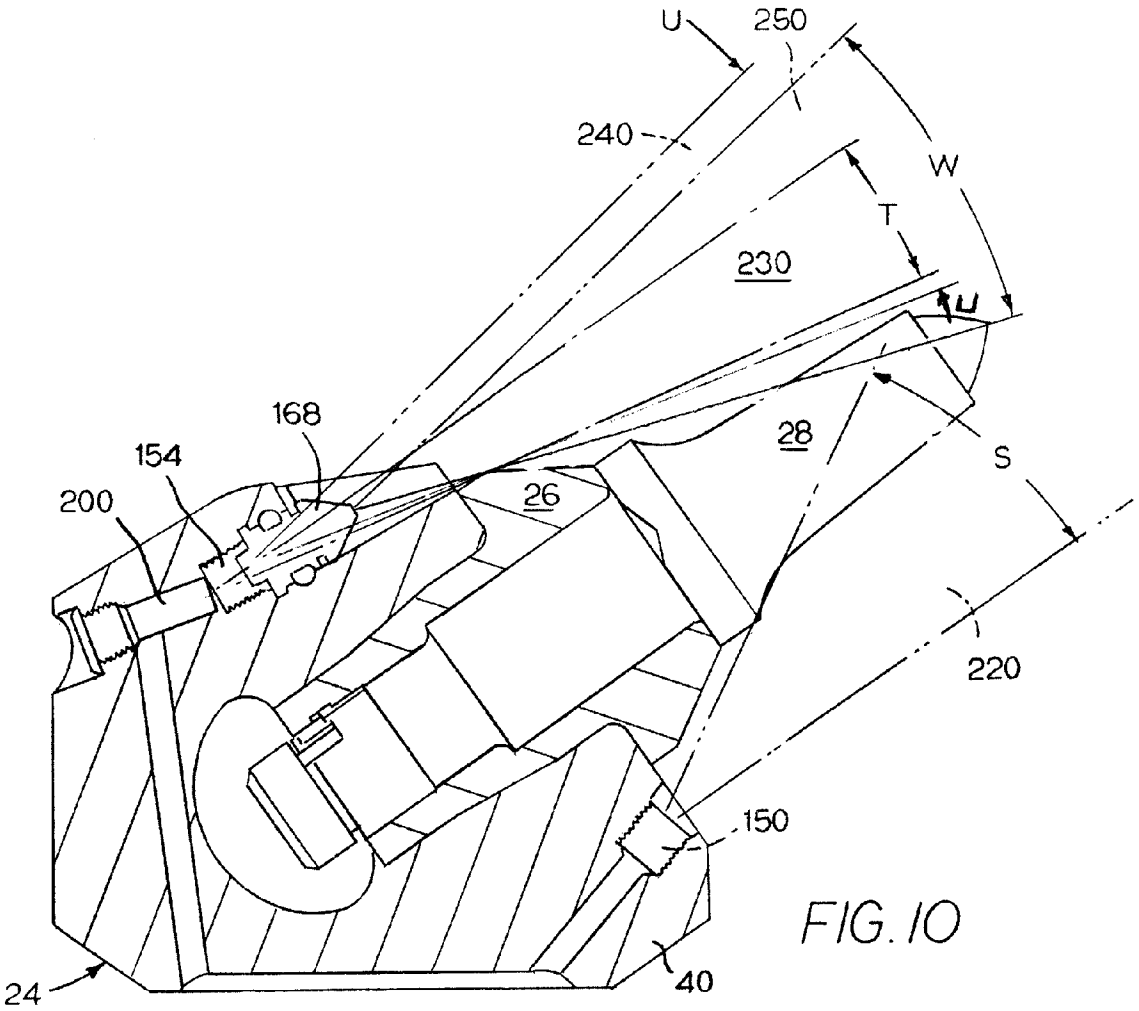
FIG. 10 is a cross-sectional schematic view of the specific embodiment of the block of FIG. 3 with a cutting bit assembly, which comprises a cutting bit and a sleeve, retained in the retention bore of the block and all of the selected spray nozzles attached to the block so as to comparatively illustrate each of the spray patterns emanating from the corresponding nozzles.

Referring to FIG. 4, and any other pertinent drawings as appropriate, there is shown a cutting assembly 29 that comprises a block 24 with a block body 40. A bottom nozzle 150, which is a hex key threaded spray nozzle, comprises an internal passage 149, which has an inlet 151, and outlet 152, and an exterior surface with a threaded region 155. The bottom nozzle 150 is used for dust suppression to suppress the dust which are the smaller particles generated by the impingement of the cutting bit against the substrate during the cutting operation. The bottom nozzle 150 is threadedly affixed via the bottom passage threaded region 104. Coolant 34 passes from the coolant source 30 through the coolant conduit 32 into the reservoir 90 exiting via the forward reservoir outlet 92 into the bottom passage 98 then flowing into the bottom nozzle 150. A bottom coolant spray 220 emanates from the bottom nozzle 150 wherein the bottom coolant spray 220 is directed toward the vicinity of the cutting bit 28. The bottom coolant spray impinges the cutting bit 28 from underneath the cutting bit 28. Referring to FIG. 10, the bottom spray 220 has a generally conical geometry represented by angle S.

There should be an appreciation that instead of using the bottom spray nozzle 150, one could use a plug in place of the bottom spray nozzle 150. The use of the plug in place of the bottom spray nozzle 150 would alter the overall spray pattern as compared to an arrangement using the bottom spray nozzle 150. The use of a plug in place of the bottom spray nozzle 150 is applicable to each of the specific embodiments of the block described herein.

Still referring to FIG. 4, and any other pertinent drawings as appropriate, a rear nozzle 200, which is a rear entry block spray nozzle, comprises an axial forward end 201 and an axial rearward end 202. There is a threaded region 204 at the axial rearward end 202. The rear nozzle 200 further has an inlet 205 to an internal passage 208 that has an outlet 210. In operation, coolant 34 exits the reservoir 90 via the rearward reservoir outlet 94 into the rear passage 110 flowing into the inlet 205 of the rear nozzle 200. The coolant passes into and through the internal passage 208 (see FIG. 4) and sprays out of the outlet 210 to form a rear top coolant spray 230. The rear top coolant spray 230 is directed toward the vicinity of the cutting bit 28. The rear top coolant spray 230 impinges the cutting bit 28 from above the cutting bit 28. Referring to FIG. 10, the rear top coolant spray 230 has a generally conical geometry and is represented by angle T (FIG. 10).

The following description of the rear coolant spray 230 is applicable to each of the various coolant sprays described herein. The rear top coolant spray 230 is illustrated as a cone in FIG. 4 and FIG. 10. In FIG. 10, the rear top coolant spray 230 exhibits a generally conical geometry with a cone angle T. There should be an appreciation that in actual use, while the basic thrust of the rear top coolant spray 230 is of a generally conical shape, the rotation of the cutting bit, the movement of the driven member, and thus the block, results in a dispersion of the coolant spray, in which are entrained particulates, including a swirling of the coolant spray. The result is that the coolant spray includes a peripheral region at the periphery of the spray cone that comprises coolant spray. It can be understood that in actual use, the geometry of the coolant spray may be generally conical, but there is a dispersion or plume of coolant associated with the coolant spray.

There should be an appreciation that the retention staple holes 146 may function to provide a venturi effect to the coolant spray when the retention staple hole 146 are not used in conjunction with the retention staple 184. For example, this would be possible when the cutting assembly uses the rear nozzle 200 (see FIG. 4) or when the cutting assembly uses the mediate spray nozzle 154 (see FIG. 5A or 5B).

Figure 5A:
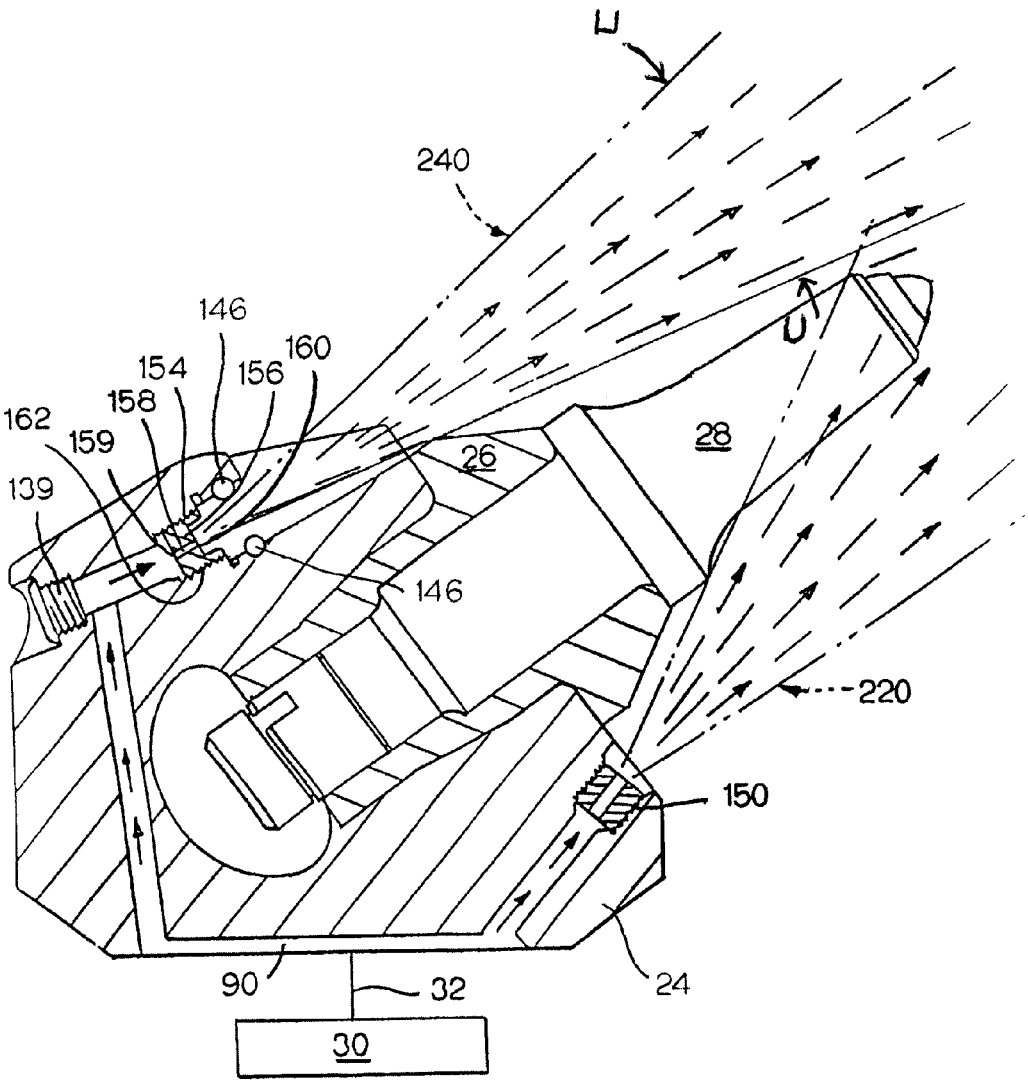
FIG. 5A is a cross-sectional view of the specific embodiment of the block of FIG. 3 with a cutting bit assembly, which comprises a cutting bit and a sleeve, retained in the retention bore of the block and a selected spray nozzle is attached to the block to deliver coolant to the vicinity of the cutting bit during a cutting operation.

Referring to FIG. 5A, and any other pertinent drawings as appropriate, there is shown a cutting assembly that comprises a block 24 with a block body 40. A bottom nozzle 150 comprises an inlet 151, and outlet 152, and exterior surface with a threaded region 155. The bottom nozzle 150 is threadedly affixed via the bottom passage threaded region 104. As mentioned above, the bottom nozzle 150 is a commercially available spray nozzle. Coolant 34 passes from the coolant source 30 through the coolant conduit 32 into the reservoir 90 exiting via the forward reservoir outlet 92 into the bottom passage 98 then flowing into the bottom nozzle 150. A bottom coolant spray 220 emanates from the bottom nozzle 150 wherein the bottom coolant spray 220 is directed toward the vicinity of the cutting bit 28. The bottom coolant spray impinges the cutting bit 28 from underneath the cutting bit 28. As described above, bottom spray 220 has a generally conical geometry represented by the angle S (see FIG. 10).

Still referring to FIG. 5A, the mediate spray nozzle 154, which is a socket head drum spray nozzle, has a mediate spray nozzle body 156 that contains an internal passage 158 with an inlet 159 and an outlet 160. The spray nozzle body 156 has a threaded region 162. In operation, coolant 34 exits the reservoir 90 via the rearward reservoir outlet 94 into the rear passage 110 flowing into the inlet 159 and out of the outlet 160 of the mediate spray nozzle 154 to form the mediate top spray 240. As shown in FIG. 10, the mediate top spray 240 has a generally conical geometry represented by angle U.

Figure 5B:
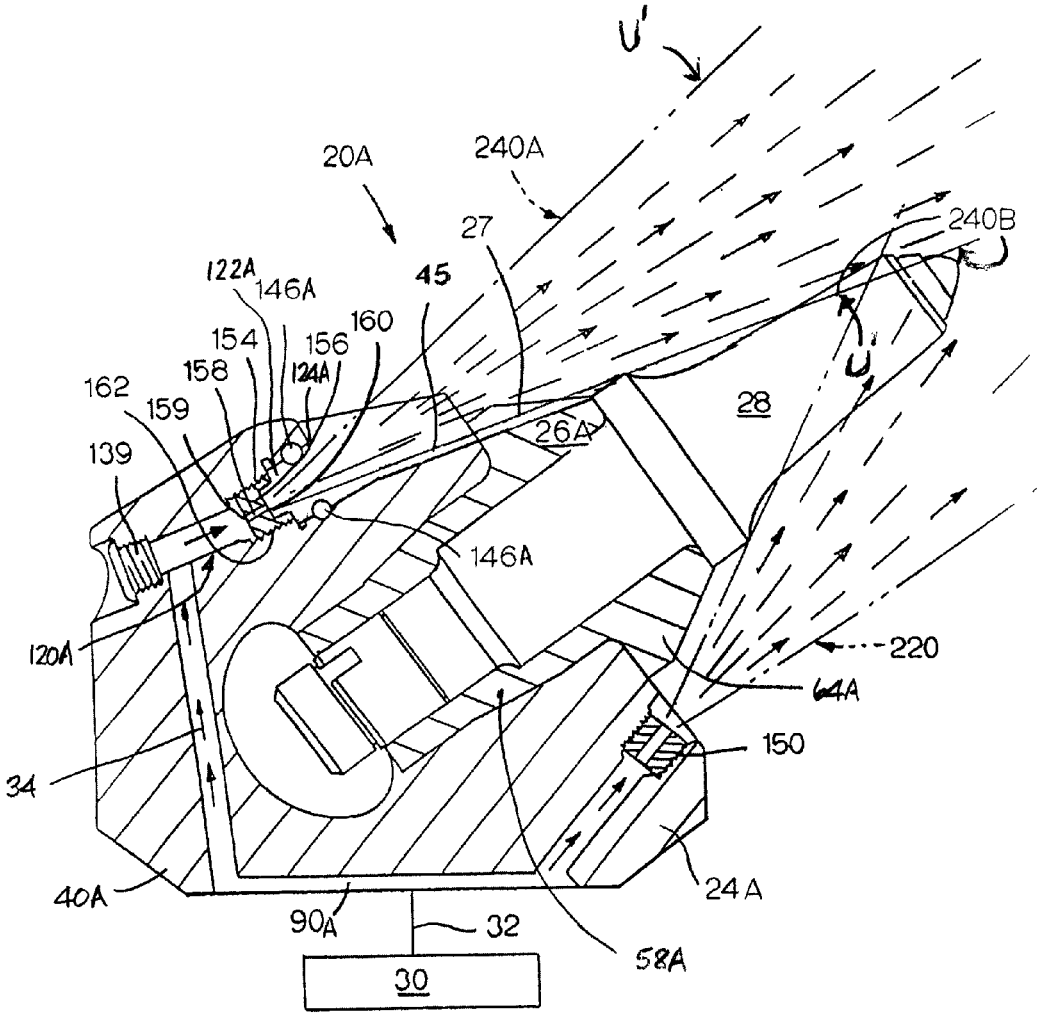
FIG. 5B is a cross-sectional view of another specific embodiment of the block of FIG. 3 wherein the block contains a notch and the sleeve contains a notch and the block notch and sleeve notch allow the coolant spray to pass therethough and function together to increase the spray pattern of the coolant spray.
Figure 5C:
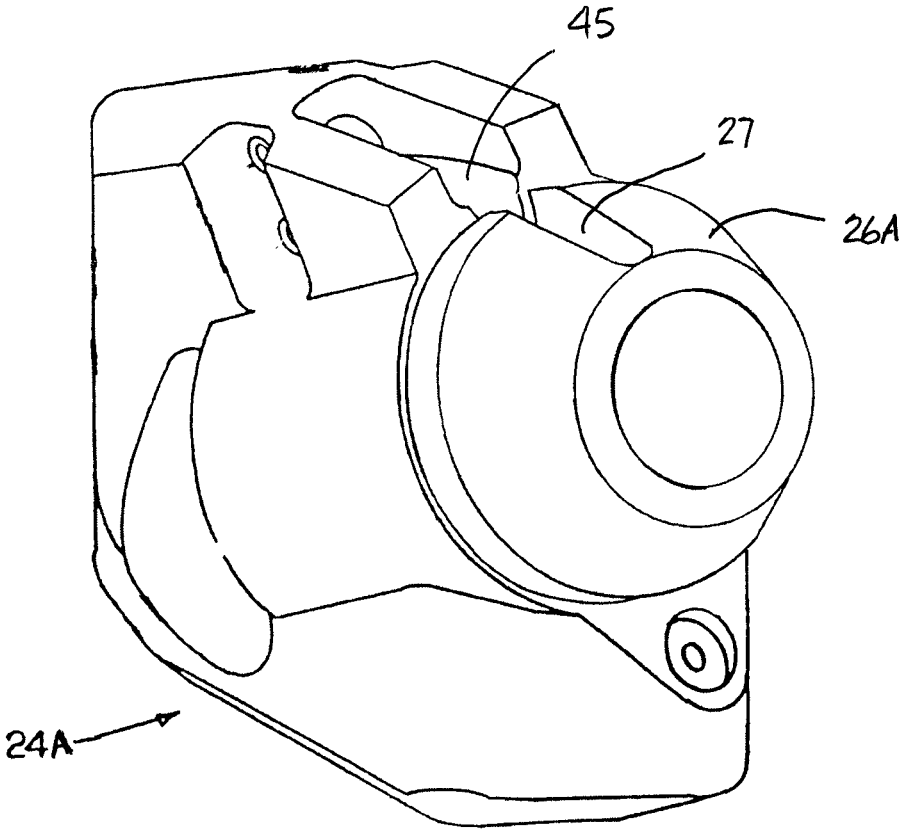
FIG. 5C is an isometric view of the block-sleeve assembly showing the block notch and the sleeve notch in alignment.

Referring to FIG. 5B, there is shown a cutting assembly 20A along the lines of the cutting assembly 20 as shown in FIG. 5A. The difference between the cutting assembly 20A is that the block with coolant delivery 24A has a block body 40A containing a block notch 45 and the sleeve 26A has a sleeve body 58A that contains a sleeve notch 27 in the head portion 64A. There should be an appreciation that FIG. 5B shows the reservoir 90A, the top passage 120A, the axial forward top passage section 122A, and the axial forward top passage end 124A. The block body notch 45 and the sleeve notch 27 are in alignment (i.e., axial alignment) and increase the pathway for the coolant spray so that the coolant spray 240A to exhibits a wider spray angle than for the cutting assembly 20. This is shown by the conical boundary 240B. The angle U as shown in FIG. 5A is less than the angle U' in FIG. 5B. The larger angle U' provides for a wider spray angle than does the smaller angle U. While this feature of the block body notch 45 and the sleeve notch 27 is shown in connection with the use of the mediate spray nozzle 154, it can be used in conjunction with the forward spray nozzle 170 or the rear spray nozzle 200. The provision of such a block 24A and sleeve 26A increase the capability to provide still another variation in the spray pattern, which is advantageous. FIG. 5C is an isometric view of the block 24A with the block notch 45 and the sleeve 26A with the sleeve notch 27.

Figure 5D:
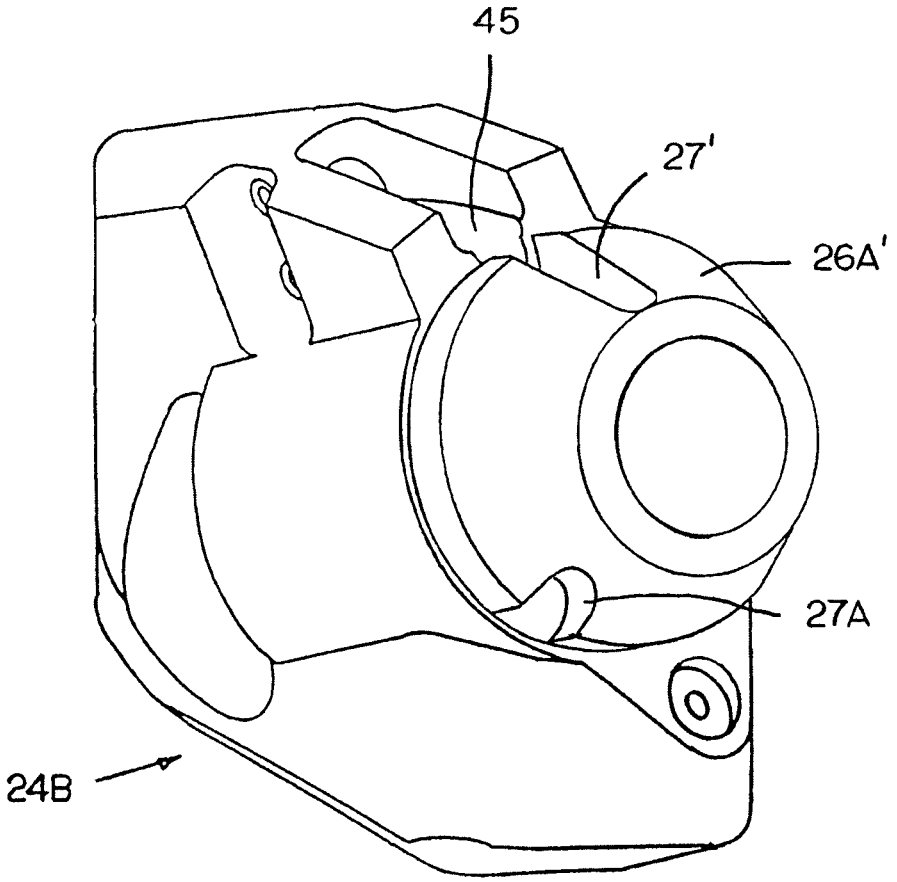
FIG. 5D is an isometric view of a block-sleeve assembly showing the block notch and a sleeve notch in alignment and the sleeve with a puller groove.

FIG. 5D is an isometric view of the block 24B with a sleeve 26A'. The sleeve 26A' has a sleeve notch 27' and a puller groove 27A. The puller groove 27A is used to assist in the removal or extraction of the sleeve from the block.

There should be an appreciation that the sleeve notch 27' (and the sleeve notch 27 of sleeve 26A) is indexable. By being indexable, the sleeve notch avoids wear and also functions to provide a puller (or extraction) feature to assist extract the sleeve from the block.

Figure 6:
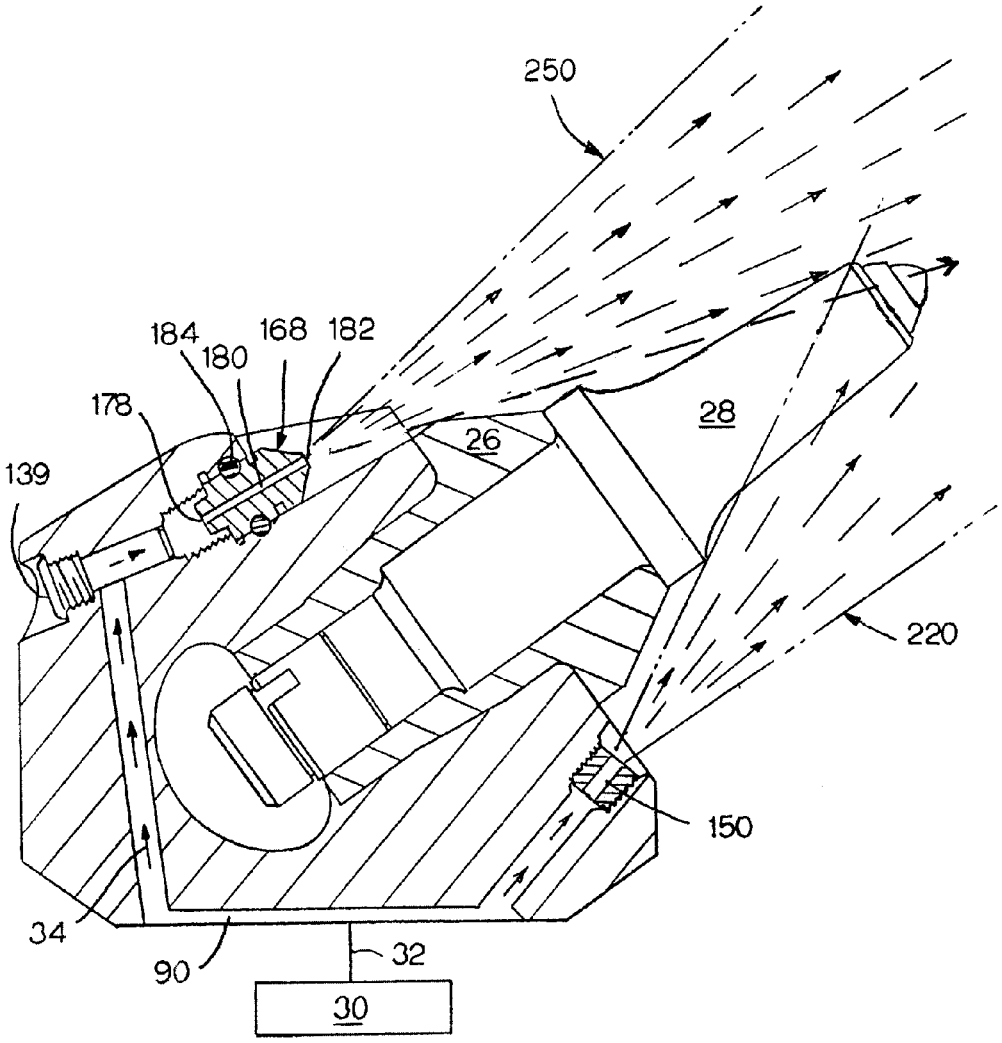
FIG. 6 is a cross-sectional view of the specific embodiment of the block of FIG. 3 with a cutting bit assembly, which comprises a cutting bit and a sleeve, retained in the retention bore of the block and a selected spray nozzle is attached to the block to deliver coolant to the vicinity of the cutting bit during a cutting operation.
Figure 6A:
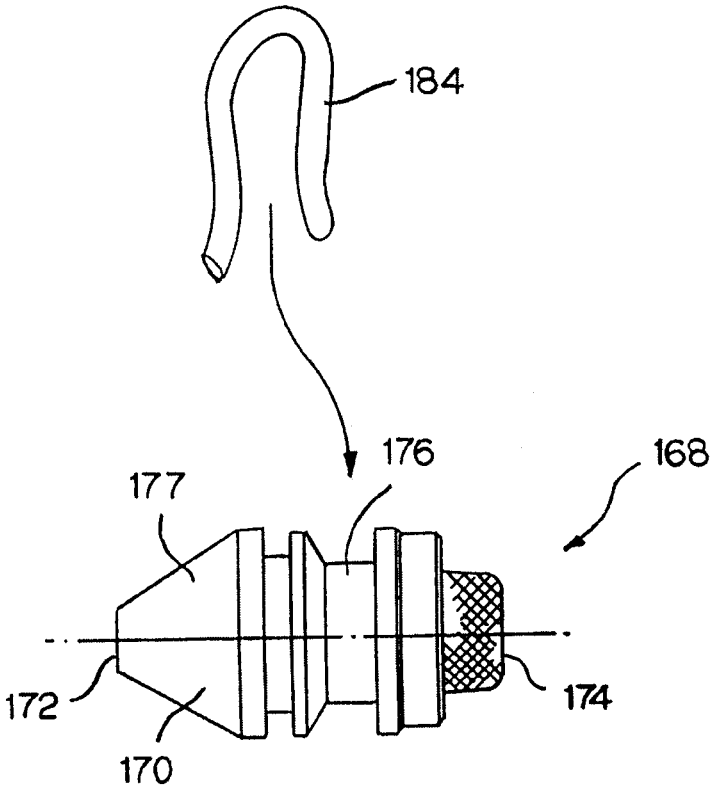
FIG. 6A is a side view of the spray nozzle (and retention staple) positioned in the top passage of the block of FIG. 6.
Figure 7:
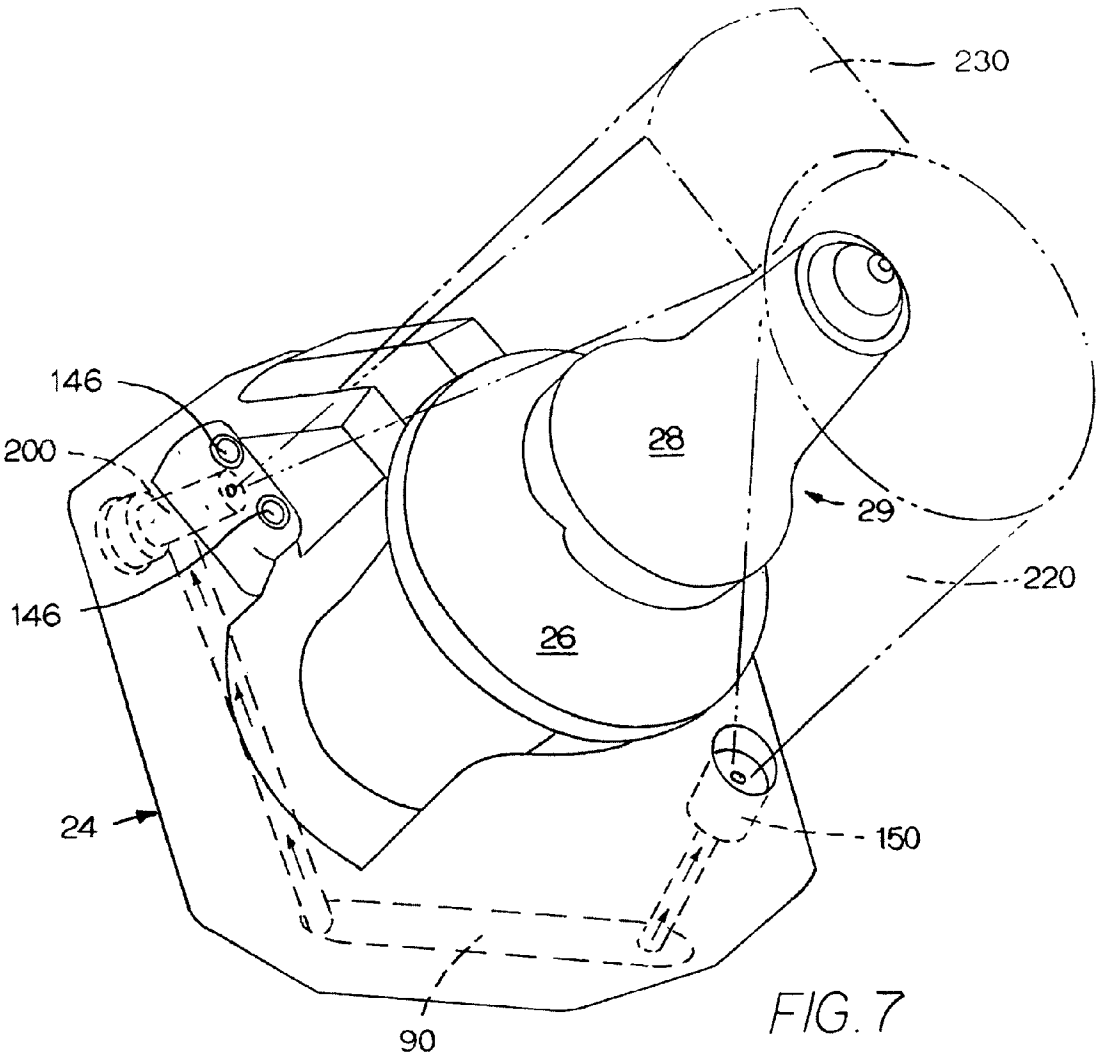
FIG. 7 is an isometric schematic view of the specific embodiment of the block of FIG. 3 with a cutting bit assembly, which comprises a cutting bit and a sleeve, retained in the retention bore of the block and a selected spray nozzle is attached to the block to deliver coolant to the vicinity of the cutting bit.
Figure 8:
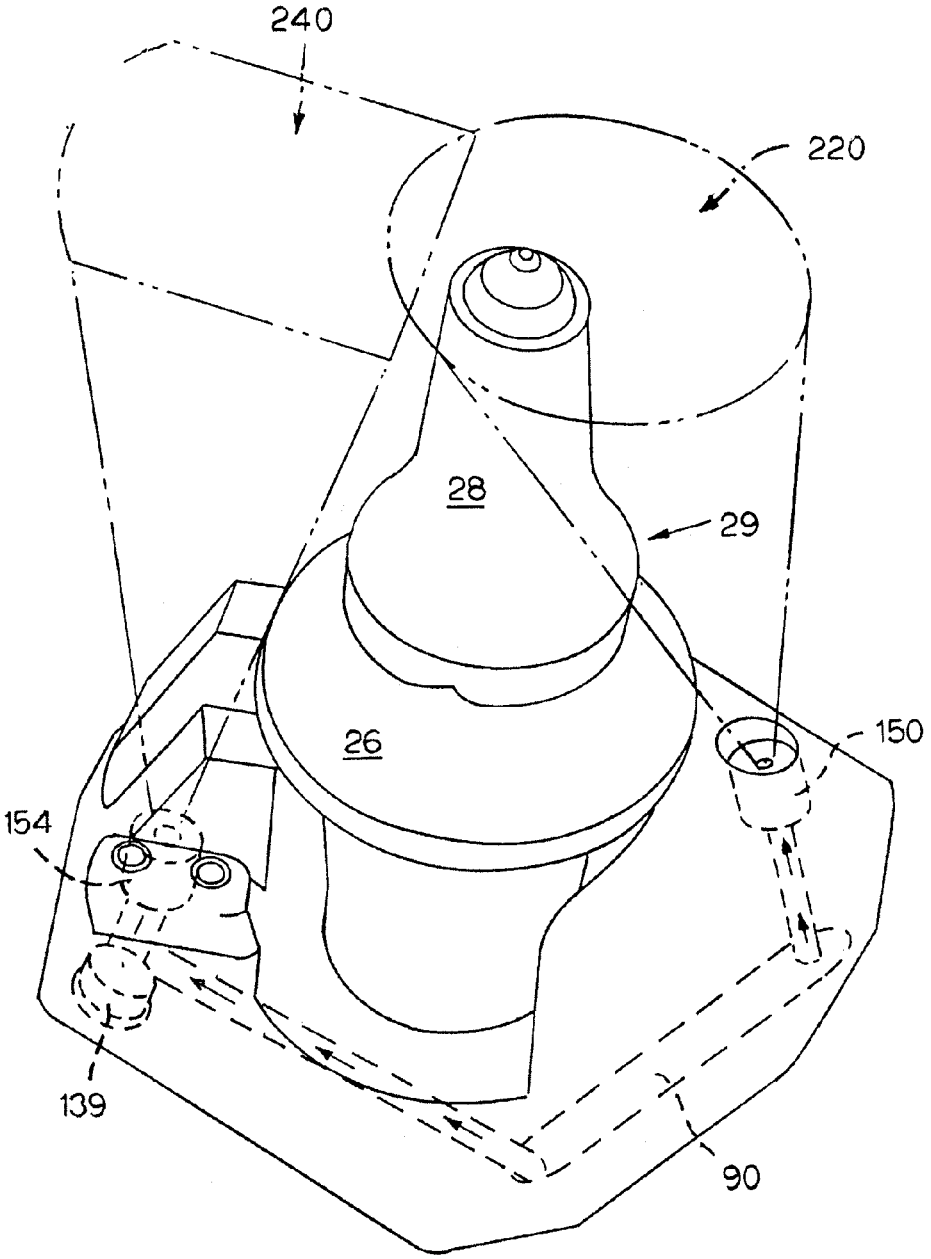
FIG. 8 is an isometric schematic view of the specific embodiment of the block of FIG. 3 with a cutting bit assembly, which comprises a cutting bit and a sleeve, retained in the retention bore of the block and a selected spray nozzle is attached to the block to deliver coolant to the vicinity of the cutting bit.

Referring to FIG. 6, and any other pertinent drawings (including FIG. 9) as appropriate, there is shown a cutting assembly that comprises a block 24 with a block body 40. A bottom nozzle 150 comprises an inlet 151, and outlet 152, and exterior surface with a threaded region 155. The bottom nozzle 150 is threadedly affixed via the bottom passage threaded region 104. Coolant 34 passes from the coolant source 30 through the coolant conduit 32 into the reservoir 90 exiting via the forward reservoir outlet 92 into the bottom passage 98 then flowing into the bottom nozzle 150. A bottom coolant spray 220 emanates from the bottom nozzle 150 wherein the bottom coolant spray 220 is directed toward the vicinity of the cutting bit 28. The bottom coolant spray impinges the cutting bit 28 from underneath the cutting bit 28. As mentioned above, the bottom nozzle 150 is a commercially available spray nozzle.

Still referring to FIG. 6, and any other pertinent drawings (including FIG. 9) as appropriate, the forward spray nozzle 168 has a forward spray nozzle body 170 with an axial forward end 172 and an axial rearward end 174. The forward spray nozzle body 170 contains a groove 176, which receives a retention staple 184, and a conical head 177. The forward spray nozzle body 170 has a coolant passage 180 with an inlet 178 and an outlet 182. In operation, coolant 34 exits the reservoir 90 via the rearward reservoir outlet 94 into the rear passage 100 flowing into the inlet 178 and out of the outlet 182 of the forward spray nozzle 168 to form a forward top spray 250 that has a generally conical geometry represented in FIG. 10 by angle W.

Figure 9:
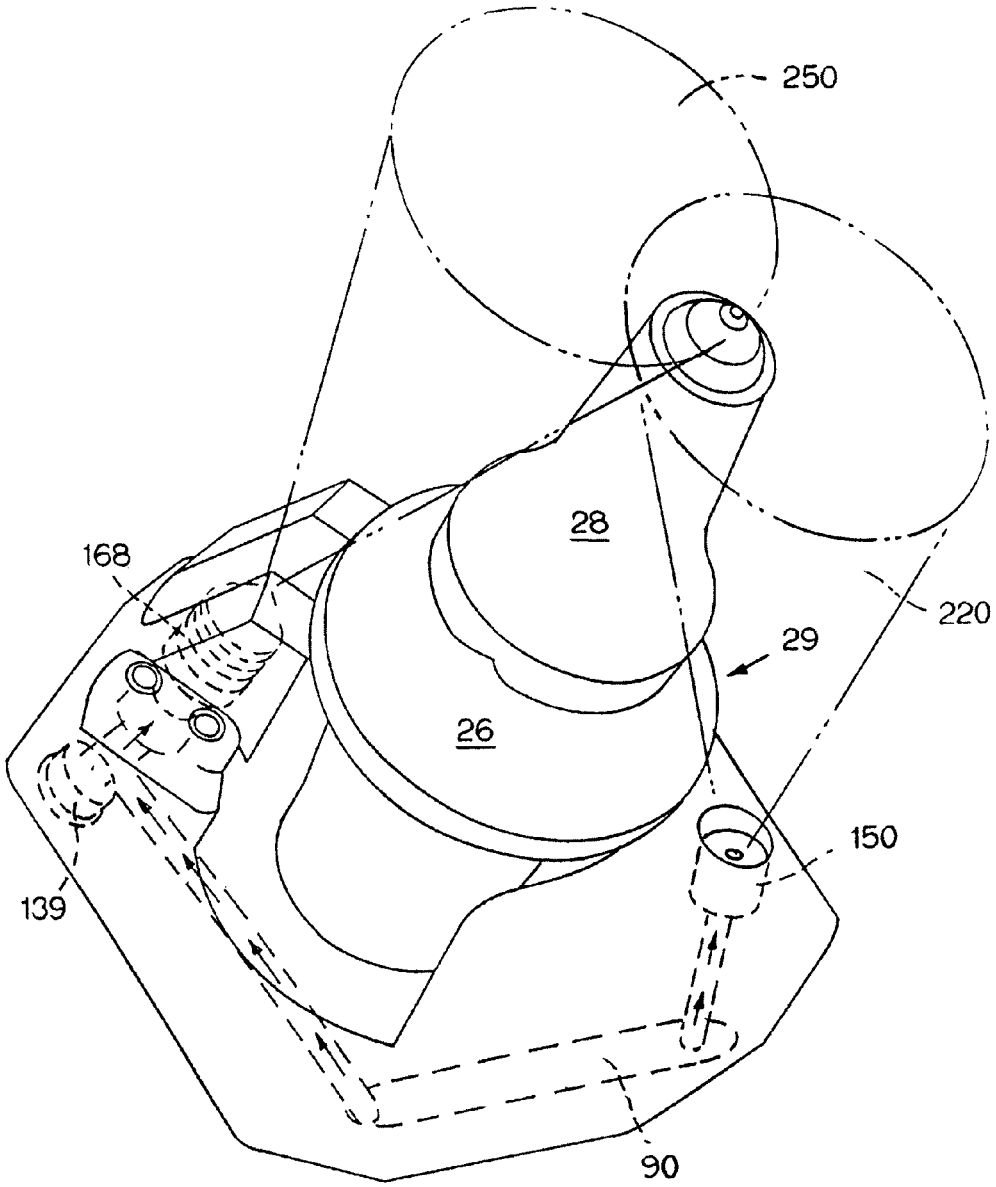
FIG. 9 is an isometric schematic view of the specific embodiment of the block of FIG. 3 with a cutting bit assembly, which comprises a cutting bit and a sleeve, retained in the retention bore of the block and a selected spray nozzle is attached to the block to deliver coolant to the vicinity of the cutting bit.
Figure 9A:
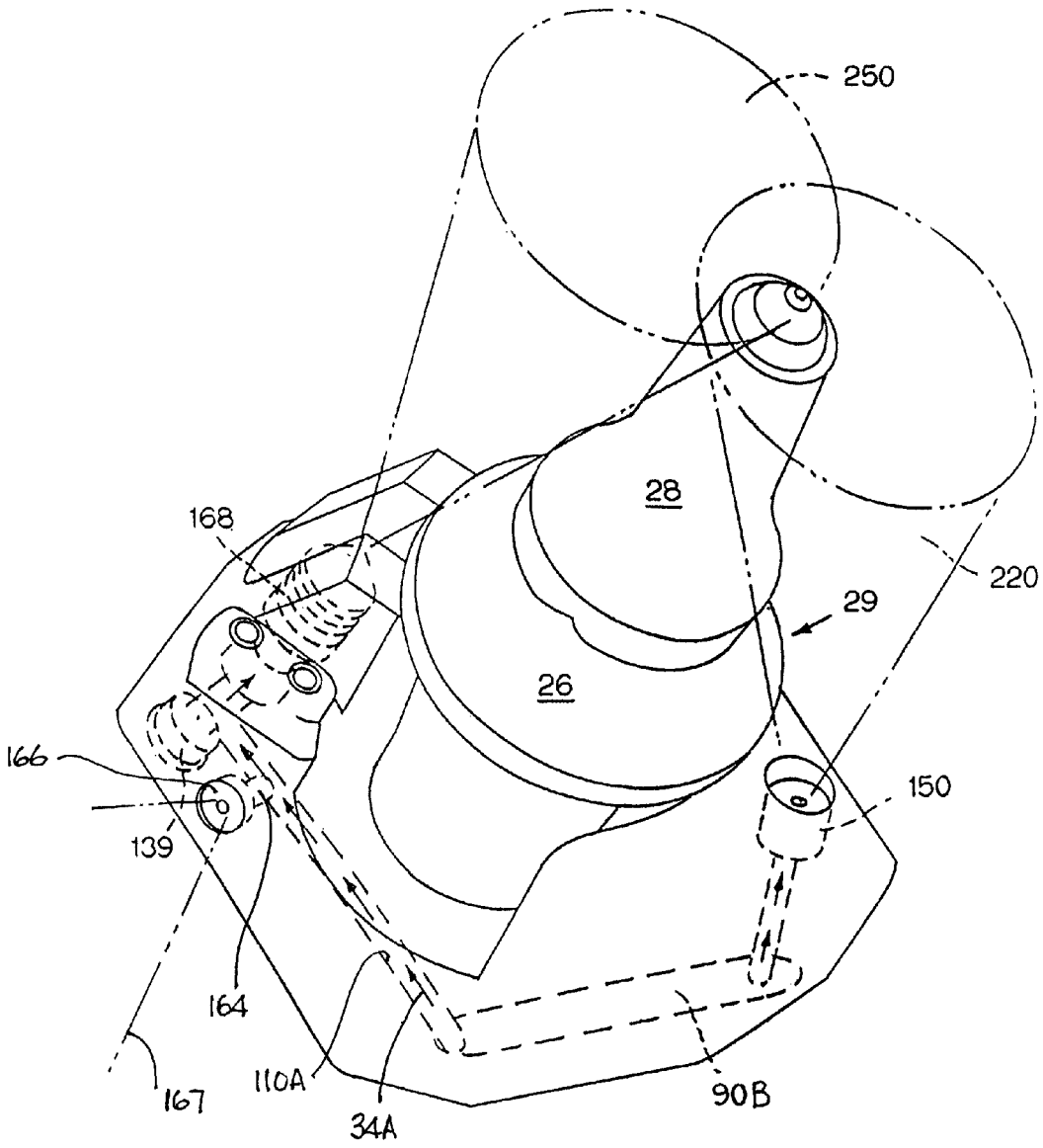
FIG. 9A is an isometric schematic view of a specific embodiment that includes a side spray feature.

Referring to FIG. 9A, there is a cutting assembly like that of FIG. 9, except that the embodiment of FIG. 9A further includes a side spray feature for each side of the block. However, FIG. 9A illustrates the side spray feature for only one side of the block. The side spray feature includes a side spray passage 164 that passes between the side surface of the block and intersects the rear passage 110A. A side spray nozzle 166 is received at the distal end of the side spray passage 164. In reference to the side spray feature, coolant (34A) passes from the reservoir 90B into the rear passage (110A) and into the side spray passage 164. Coolant exits the side spray passage 164 via the side spray nozzle 166 in a side spray 167. In addition, coolant travels through and exist from the embodiment of FIG. 9A along the lines of the coolant travel and exit from the embodiment of FIG. 9.

Figure 11:
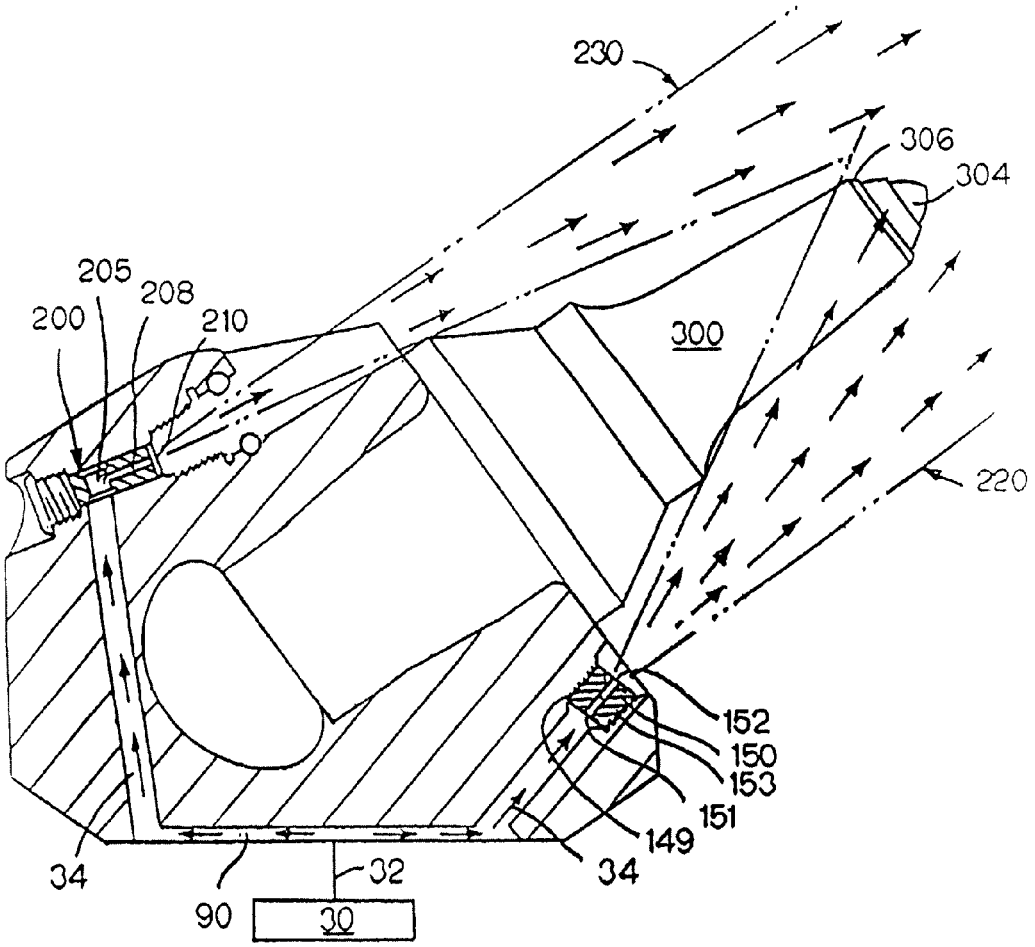
FIG. 11 is a cross-sectional view of a block like the block of FIG. 4 and wherein the cutting bit is a PCD (polycrystalline diamond) cutting bit.

Referring to FIG. 11, there is shown a block with coolant delivery that is like the block with coolant delivery in FIG. 4 and a PCD (polycrystalline diamond) cutting bit 300 carried by the block. For sake of brevity, the structure of the block with coolant delivery of FIG. 4 will not be described but as necessary. FIG. 12 shows that the PCD cutting bit 300 has a cutting bit body and a PCD (polycrystalline diamond) insert 304 at the axial forward end 306 thereof. There should be an appreciation that the PCD cutting bit 300 comprises a single cutting bit body and does not include a separate sleeve. Further, there should be the appreciation the PCD insert 304 may be comprised of other kinds of superhard materials such as, for example, polycrystalline cubic boron nitride (PcBN).

It becomes apparent that the present block provides for the improved delivery of coolant to the vicinity of the cutting bit. The present block provides a block with coolant delivery that can present a selected coolant spray pattern customized to correspond to a specific cutting application. Customization of the spray pattern results in an enhancement of the delivery of the coolant to the vicinity of the cutting bit during a cutting operation. By enhancing the delivery of coolant in the vicinity of the cutting bit during the cutting operation, the block provides operational advantages not heretofore available. More specifically, one advantage of the block with coolant delivery is the capability of the block to deliver coolant to the substrate prior to the impingement of the substrate with the cutting bit. This feature provides for dust suppression during the mining operation.

Yet, another advantage of the block is the selective delivery of coolant to the vicinity of the tip of the cutting bit, as well as to the vicinity of the rear of the cutting bit. Sparks generated from the impingement of the tip of the cutting bit on the substrate occur both in the vicinity of the tip and at a location to the rear of the tip of the cutting bit. Another advantage of the block with coolant delivery is the variability of the coolant spray pattern due to the capability of the block to provide a variety of spray patterns depending upon the nozzle selection.

Another advantage is that the block with coolant delivery is indexable. The index-ability of the block with coolant delivery allows for using the blocks in conjunction with either a right-handed vane or a left-handed vane. This feature of index-ability reduces the number of blocks that must be kept in inventory since the block with coolant delivery can be used in conjunction with either a right-handed vane or a left-handed vane. It is not necessary to inventory a special right-handed block and a special left-handed block.

Another advantage with the block with coolant delivery is that it presents a footprint which allows it to be welded so as to have a better weld. More specifically, the geometry of the footprint on the base of the block is such that there is a 360° weld around the base of the block to the vane of the longwall miner drum. The base of the block with coolant delivery does not exhibit any overhang thereof relative to the vane, and thus, it able to provide for an improved weld, and to enhance the ease of welding the block to the vane. This advantage of an improved weld due to the footprint of the block applies to both the right-handed vane and the left-handed vane.

Still another advantage is that the forward face of the block with coolant delivery displays a plow design to divert material upon impingement with the coal (or earth) strata.

The patents and other documents identified herein are hereby incorporated by reference herein. Other embodiments of the invention will be apparent to those skilled in the art from a consideration of the specification or a practice of the invention disclosed herein. It is intended that the specification and examples are illustrative only and are not intended to be limiting on the scope of the invention. The true scope and spirit of the invention is indicated by the following claims.

What is claimed is:

1. A block for use in a cutting assembly wherein the cutting assembly comprises a cutting bit assembly, a driven member and a coolant source, the block comprising:

a block body containing a reservoir with coolant therein;

the block body further containing a top passage, and the top passage being in operative communication with the reservoir so as to receive coolant from the reservoir;

the top passage having an axial forward top passage section terminating in an axial forward top passage end, and the axial forward top passage section having an axial forward top passage section central longitudinal axis;

the top passage further having an axial rearward top passage section terminating in an axial rearward top passage end, and the axial rearward top passage section having an axial rearward top passage section central longitudinal axis; and the axial forward top passage section central longitudinal axis is disposed at an angle with respect to the axial rearward top passage section central longitudinal axis, wherein the block is capable of use in a rear top spray condition, a mediate top spray condition, or a forward top spray condition, wherein when the block is in the rear top spray condition, a rear spray nozzle is positioned in the axial rearward top passage section of the top passage whereby a rear top spray emanates from the rear spray nozzle;

wherein when the block is in the mediate top spray condition, a mediate spray nozzle is positioned in the axial forward top passage section of the top passage whereby a mediate top spray emanates from the mediate spray nozzle; and wherein when the block is in the forward top spray condition, a forward spray nozzle is positioned in the axial forward top passage section of the top passage whereby a forward top spray emanates from the forward spray nozzle.

2. The block according to claim 1 wherein the block body further contains a bottom passage in operative communication with the reservoir so as to receive coolant from the reservoir, and a bottom nozzle being positioned in the bottom passage whereby a bottom spray emanates from the bottom nozzle.

3. The block according to claim 1 wherein the axial forward top passage section central longitudinal axis is disposed at an angle ranging between 1 degree and 20 degrees with respect to the axial rearward top passage section central longitudinal axis.

4. The block according to claim 1 wherein the axial forward top passage section central longitudinal axis is disposed at an angle ranging between 5 degrees and 15 degrees with respect to the axial rearward top passage section central longitudinal axis.

5. The block according to claim 1 wherein the block body further contains a retention bore having a retention bore central longitudinal axis, and the axial forward top passage section central longitudinal axis is disposed at an angle relative to the retention bore central longitudinal axis ranging between 1 degree and 15 degrees.

6. The block according to claim 1 wherein the block body further contains a retention bore having a retention bore central longitudinal axis, and the axial forward top passage section central longitudinal axis is disposed at an angle relative to the retention bore central longitudinal axis ranging between 1 degree and 10 degrees.

7. The block according to claim 1 wherein the block body further contains a retention bore having a retention bore central longitudinal axis, and the axial rearward top passage section central longitudinal axis is disposed at an angle relative to the retention bore central longitudinal axis ranging between 5 degrees and 25 degrees.

8. The block according to claim 1 wherein the block body further contains a retention bore having a retention bore central longitudinal axis, and the axial rearward top passage section central longitudinal axis is disposed at an angle relative to the retention bore central longitudinal axis ranging between 10 degrees and 20 degrees.

9. The block according to claim 1, wherein:

the axial rearward top passage end defines a rear opening having an axial rearward top passage section threaded region;

when the block is in the rear top spray condition, the rear spray nozzle is inserted into the axial rearward section of the top passage through the rear opening;

when the block is in the mediate top spray condition or the forward top spray condition, a plug is affixed to the block via the axial rearward top passage section threaded region.

10. The block according to claim 1, wherein the rear spray nozzle is a rear entry block spray nozzle comprising an axial forward end, an axial rearward end, a threaded region at the axial rearward end, an inlet passage between the axial rearward end and the axial forward end of the rear spray nozzle; and when the block is in the rear top spray condition, the inlet of the rear entry block spray nozzle is in fluid communication with an internal coolant passage, the internal coolant passage being disposed at a first angle relative to the axial forward top section of the top passage and being disposed at a second angle relative to the axial rearward top section of the top passage.

11. A block for use in a cutting assembly wherein the cutting assembly comprises a driven member, a coolant source, and a cutting bit assembly, the block comprising:

a block body having a bottom face, a top face, a forward face, and a rearward face;

the block body containing a retention bore adapted to receive a cutting bit, and the retention bore having a retention bore central longitudinal axis;

the block body containing a reservoir at the bottom face wherein the reservoir is in communication with the coolant source so as to receive coolant from the coolant source;

the reservoir having a forward reservoir outlet and a rearward reservoir outlet;

the block body containing a bottom passage having an axial forward bottom passage end and an axial rearward bottom passage end, the axial rearward bottom passage end being at the forward reservoir outlet of the reservoir whereby the bottom passage receives coolant from the reservoir through the forward reservoir outlet and the axial rearward bottom passage end, and the bottom passage containing a bottom passage threaded region adjacent the axial forward bottom passage end;

the block body containing a rear passage having a top rear passage end and a bottom rear passage end, the bottom rear passage end being at the rearward reservoir outlet whereby the rear passage receives coolant from the reservoir through the rearward reservoir outlet and the bottom rear passage end;

the block body containing a top passage having an axial forward top passage section terminating in an axial forward top passage end, and the axial forward top passage section having an axial forward top passage section central longitudinal axis;

the top passage further having an axial rearward top passage section terminating in an axial rearward top passage end, and the axial rearward top passage section having axial rearward top passage section central longitudinal axis;

the axial forward top passage section central longitudinal axis is disposed at an angle with respect to the axial rearward top passage section central longitudinal axis;

the top rear passage end intersects the top passage in the axial rearward top passage section;

the axial rearward top passage section containing a rearward top passage threaded region adjacent the axial rearward top passage end, the axial forward top passage section containing a forward top passage threaded region adjacent the axial forward top passage end; and the block body containing retention staple holes adjacent the axial forward top passage end.

12. The block according to claim 11 further comprising a side spray passage intersecting the rear passage, and a side spray nozzle in the side spray passage.

13. A block-sleeve assembly for use in a cutting assembly wherein the cutting assembly comprises a cutting bit, a driven member and a coolant source, the block-sleeve assembly comprising:

a sleeve having a sleeve body with a head portion that contains a sleeve notch; and the block according to claim 1, the block further defining a block notch adjacent to the axial forward top passage end; and wherein the block notch is in alignment with the sleeve notch to facilitate flow of coolant from the top passage; and wherein the sleeve is non-rotatable relative to the block.

14. The block-sleeve assembly according to claim 13 wherein the sleeve further contains a puller groove.

15. The block according to claim 11, wherein:

the rearward top passage threaded region adjacent the axial rearward top passage end is adjacent an opening in the rearward face of the block, the opening and the rearward top passage threaded region being adapted to receive a rear spray nozzle inserted into the rearward face of the block.

* * * * *